United States Patent [19]

Dorsch

[11] 4,355,617

[45] Oct. 26, 1982

[54] FUEL INJECTION SYSTEM FOR INTERNAL COMBUSTION ENGINES WITH CONTINUOUS INJECTION IN THE INTAKE PIPE

[75] Inventor: Heinz Dorsch, Weissach, Fed. Rep. of Germany

[73] Assignee: Dr. Ing. h.c.F. Porsche A.G., Stuttgart, Fed. Rep. of Germany

[21] Appl. No.: 189,866

[22] Filed: Sep. 22, 1980

[30] Foreign Application Priority Data

Sep. 22, 1979 [DE] Fed. Rep. of Germany ..... 2938406

[51] Int. Cl.[3] ..... F02M 59/32

[52] U.S. Cl. ..... 123/453; 123/588

[58] Field of Search ..... 123/588, 585, 590, 453

[56] References Cited

U.S. PATENT DOCUMENTS

| | | | |
|---|---|---|---|
| 2,860,616 | 11/1958 | Dermond | 123/585 |
| 3,494,340 | 2/1970 | Weber et al. | 123/453 |
| 4,121,549 | 10/1978 | Martin et al. | 123/590 |
| 4,159,703 | 7/1979 | Mayer | 123/585 |
| 4,187,821 | 2/1980 | Zebli | 123/588 |
| 4,227,496 | 10/1980 | Martel | 123/585 |
| 4,253,441 | 3/1981 | Kawamura et al. | 123/445 |
| 4,257,375 | 3/1981 | Ulrich | 123/453 |

*Primary Examiner*—Ira S. Lazarus
*Assistant Examiner*—Magdalen Moy
*Attorney, Agent, or Firm*—Paul M. Craig, Jr.

[57] ABSTRACT

An arrangement to eliminate the disadvantage of explosions caused by intake line backfiring resulting under cold engine starting conditions of internal combustion engines equipped with fuel injection systems of the type that inject, under cold starting conditions, additional fuel in finely divided form into the manifold intake pipe. In an improved fuel injection system, a fuel distribution arrangement comprising a fuel admitting portion communicating with an injection nozzle, and fuel feed components each of which extends from the admitting portion to a corresponding one of a plurality of intake lines to the engine is provided in the manifold intake pipe. A supply of air bypassing a primary intake pipe choke is forced into the fuel admitting portion and because of the high flow rate in the admission tube, the air is mixed very thoroughly therein with the fuel injected so that a uniformly distributed air-fuel mixture is obtained and fuel deposited on the admission tube inner wall is moved immediately to the cylinders, such that flames backfiring from combustion chambers of the engine cannot initiate explosions.

6 Claims, 1 Drawing Figure

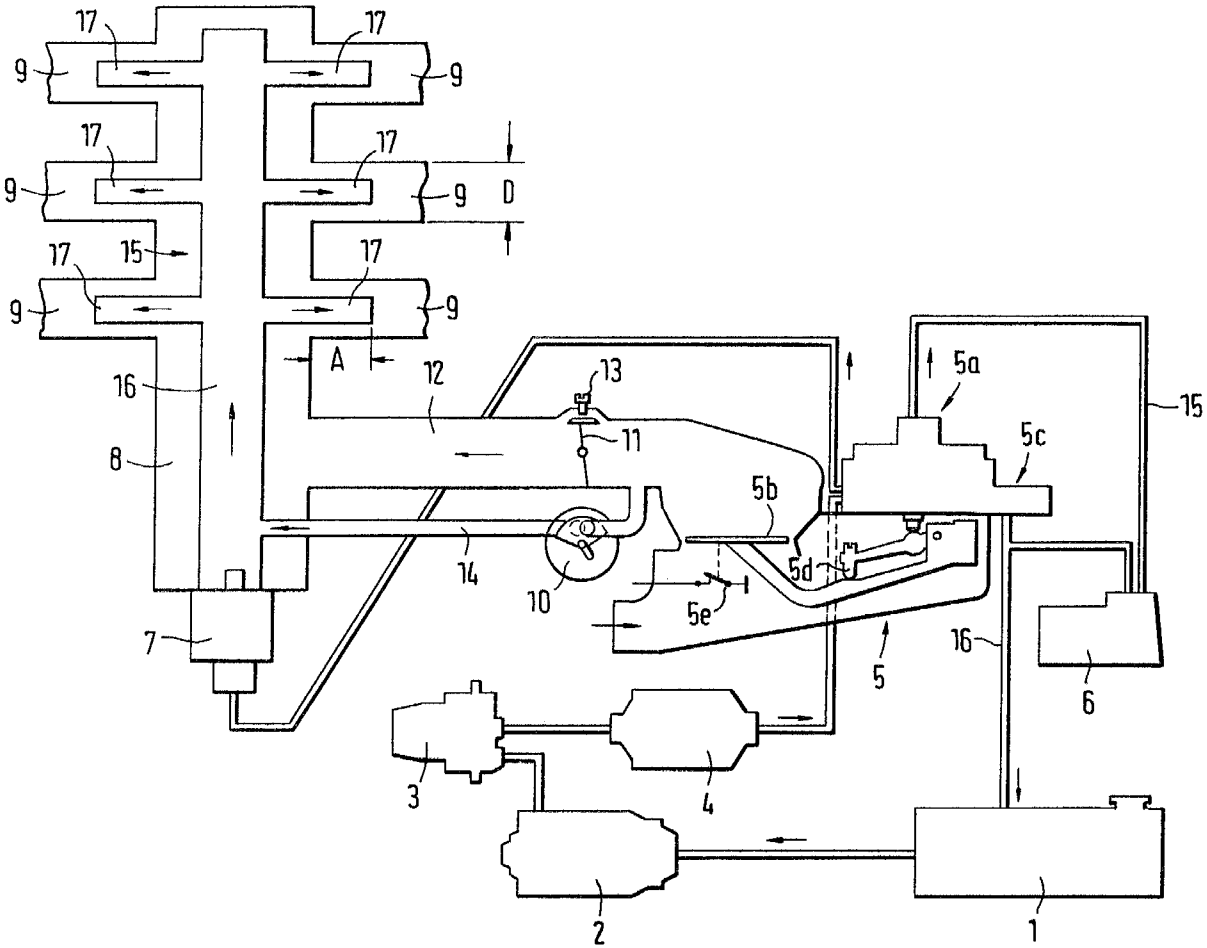
15
6
1
5c
5a
16
5
5d
5b
5e
4
2
13
11
10
3
D
9
17
A
12
14
7
8
16
15

FUEL INJECTION SYSTEM FOR INTERNAL COMBUSTION ENGINES WITH CONTINUOUS INJECTION IN THE INTAKE PIPE

BACKGROUND AND SUMMARY OF THE INVENTION

The invention relates to a fuel injection system for internal combustion engines such as mixture compressing, external ignition, four stroke cycle internal combustion engines with injection in the intake pipe, comprising a primary intake pipe in which an air metering element and an intentionally actuated choke are arranged in succession, all the intake lines and the primary intake pipe opening into a common manifold intake pipe into which fuel is injected by an electromagnetically actuated injection nozzle for cold starting of the internal combustion engine. In a known internal combustion engine of this type additional fuel in finely divided form is injected into the manifold intake pipe for cold start (Bosch Technical Information: K-Jetronic Injection, issue No. 1,1974). In this case the injection nozzle operates in the engine starting process, and the duration of the opening of said nozzle is limited by a thermal time switch. When the engine is started at a relatively high temperature the thermal time switch totally prevents the opening of the injection nozzle. In the manifold intake pipe the atomized fuel is mixed with the suction air, but, because of the relatively slow air speed, a fraction of the fuel deposits on the inner surface of the manifold intake pipe and can ignite during the hot air operational phase of the engine due to the suction line backfiring which results from the lean mixture or from delayed combustion. The subsequent explosion causes considerable mechanical damage to parts such as the choke and the air metering element.

Thus, an object of the present invention is to eliminate the disadvantage of explosions caused by intake line backfiring, while retaining the advantages of said additional fuel injection.

According to a preferred embodiment of the invention, this object is achieved by the provision of a fuel distribution arrangement in the manifold intake pipe. Said fuel distribution arrangement consists of a fuel admitting portion and fuel feed components, such air being supplied to the fuel admitting portion by a line bypassing the choke. The fuel admitting portion consists of an admission tube extending axially in the manifold suction pipe, and the fuel feed components consist of distribution lines extending from the admission tube to each intake line. Each fuel feed component branches off advantageously in the immediate vicinity of the corresponding intake line of the fuel admitting portion. The bypass line opens directly into the fuel admitting portion, in the zone of the injection nozzle, and the injection nozzle is located in the zone of the fuel admitting portion opposite the fuel feed components. A temperature responsive, additional air valve is arranged in the bypass line. The provision of fuel feed components extending into the intake lines by a distance approximately equal to the inner diameter of the intake lines has been found especially advantageous.

The advantages of the invention consist especially in the formation of a very good mixture that is ignitable at the lowest temperature in the event of a cold engine start. Because of the high flow rate in the admission tube, air is mixed very thoroughly therein with fuel, a uniform distribution of the air-fuel mixture is obtained, and the fuel deposited on the admission tube inner wall is moved immediately to the cylinders. Therefore, the flames backfiring from the combustion chambers cannot initiate explosions, and the intensive mixing of the fuel with the air and the uniform distribution of the mixture to all the cylinders provide for very fast starts.

These and further objects, features and advantages of the present invention will become more obvious from the following description when taken in connection with the accompanying drawing which shows, for purposes of illustration only, a single embodiment in accordance with the present invention.

BRIEF DESCRIPTION OF THE DRAWINGS

The sole FIGURE of the drawings illustrates, schematically, a preferred embodiment of a fuel injection system according to the present invention.

DETAILED DESCRIPTION OF THE PREFERRED EMBODIMENT

Fuel is supplied from a fuel tank 1 to a mixture regulator 5 by an electric fuel pump 2 through a fuel accumulator 3 and a fuel filter 4 to a mixture regulator of the known Bosch type. Mixture regulator 5 comprises a fuel divider 5*a*, an air metering element 5*b*, a system pressure regulator 5*c*, a mixture regulating screw 5*d*, and an air quantity measuring contact 5*e*. Numeral 6 designates a warm-up regulator of known design, 7 an electromagnetically operated injection nozzle, 8 a manifold intake pipe from which extend the intake lines 9 of an internal combustion engine (not represented), 10 a temperature responsive, additional air valve, 11 a choke mounted in a primary intake pipe 12, and 13 an idle setscrew. Additional air valve 10 is mounted in a line 14 bypassing choke 11, and consists of a known cutoff means with an orifice plate which opens the air passage when the engine is cold, and closes said passage with an electrically heated bimetal element. Manifold intake pipe 8 comprises a fuel distribution arrangement 15 consisting of a fuel admitting portion 16 and fuel feed components 17 extending therefrom to separate intake lines 9. Suction air is supplied to fuel admitting portion 16 by bypass line 14. Fuel admitting portion 16, into which fuel is injected by injection nozzle 7, consists of an admission tube extending axially in manifold intake pipe 8, and fuel feed components 17 consist of distribution lines, each line extending to one intake line 9. Distribution lines 17 advantageously branch off from the admission tube in the immediate vicinity of the corresponding intake line 9.

Bypass line 14 opens directly into fuel admitting portion 16, in the zone of injection nozzle 7, and injection nozzle 7 is located in the zone of fuel admission portion 16 opposite fuel feed components 17. Fuel feed components 17 extend approximately by a distance A into intake lines 9, and said distance is equal to the inner diameter D of intake lines 9.

The system of the invention operates as follows: The fuel injection system is a mechanical, continuously operating injection system for internal combustion engines, and requires no drive from the engine. The fuel is conveyed by an electrically driven rotary bucket pump 2. The quantity of air sucked in during operation is measured by air metering element 5*b* located upstream of the choke 11 of the engine. Depending on the position of choke 11 or of the accelerator pedal, more or less air is sucked in. According to the measured quantity of air fuel divided, 5*a* distributes to the individual cylinders of the engine through each injection nozzle a quantity of fuel which determines the optimum mixture in respect to engine efficiency, fuel consumption, and exhaust gas composition. Air metering element 5*b* and fuel divider 5*a* are combined in one unit: mixture regulator 5. The exactly measured quantity of air is supplied to the injection nozzles which spray the fuel continuously in finely divided form to the intake lines upstream of the intake valves of the engine cylinders.

To start the internal combustion engine when it is in a cold condition, additional fuel is injected by injection nozzle 7 in finely divided form into fuel admitting portion 16. On starting of the engine injection nozzles 7 are operated and the injection time is limited by a thermal time switch.

Because of the high flow rate in fuel admitting portion 16, the air issuing from the bypass line 14 is mixed very thoroughly therein with the fuel, a uniform distribution of the air-fuel mixture is obtained, and the fuel deposited on the inner wall of the fuel admitting portion is immediately moved to the cylinders. Therefore, the flames backfiring from the combustion chambers cannot initiate explosions, and the intensive mixing of the fuel with the air and the uniform distribution of the mixture to all the cylinders result in very fast starts and low exhaust gas emission.

While I have shown and described one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A fuel injection system for a mixture compressing, external ignition, four stroke cycle internal combustion engine with fuel injection in an intake pipe, comprising a primary intake pipe in which an air metering element and an intentionally actuated choke are arranged in succession, a plurality of intake lines for supplying an air-fuel mixture to engine cylinders, all of the intake lines and the primary intake pipe opening into a common manifold intake pipe and an electromagnetically actuated injection nozzle for cold starting of the internal combustion engine, characterized in that a fuel distribution arrangement is provided within the manifold intake pipe and comprises a fuel admitting portion and fuel feed components each of which extends from said admitting portion to a corresponding one of said intake lines, wherein an air supply means bypassing said choke is provided for forcing air directly into the fuel admitting portion bypassing the choke, and wherein said injection nozzle supplies fuel into said fuel admitting portion, whereby the air from said air supply means and fuel from said injection nozzle are thoroughly mixed within said admitting portion and uniformly distributed by the fuel feed components to the respective intake lines to the engine cylinders.

2. The fuel injection system as in claim 1, characterized in that the fuel admitting portion comprises an admission tube extending axially in the manifold intake pipe, and the fuel feed components comprise distribution tubes each of which extends from the admission tube into a respective intake line.

3. The fuel injection system as in claim 1, characterized in that each fuel feed component branches off of said fuel admitting portion in the immediate vicinity of the corresponding intake line.

4. The fuel injection system as in claim 1, characterized in that the said air supply means is a bypass line opening directly into the fuel admitting portion in a zone of the injection nozzle, and the injection nozzle is located in a zone of the fuel admitting portion located at an opposite end of the fuel admitting portion relative to the fuel feed components.

5. The fuel injection system as in claim 1, characterized in that said air supply means is a bypass line branched-off from said primary intake pipe upstream of said choke and a temperature responsive, additional air valve is arranged in the bypass line.

6. The fuel injection system as in claim 1 or 2 or 3 or 4 or 5, characterized in that the fuel feed components extend a distance into the intake lines that is approximately equal to the inner diameter of the intake lines.

* * * * *